US008367292B2

(12) United States Patent
Kusahara et al.

(10) Patent No.: US 8,367,292 B2
(45) Date of Patent: Feb. 5, 2013

(54) TONER AND DEVELOPMENT AGENT

(75) Inventors: Teruki Kusahara, Numazu (JP); Junichi Awamura, Numazu (JP); Tomomi Suzuki, Numazu (JP); Toshihiko Karato, Numazu (JP)

(73) Assignee: Ricoh Company, Limited, Tokyo (JP)

( * ) Notice: Subject to any disclaimer, the term of this patent is extended or adjusted under 35 U.S.C. 154(b) by 430 days.

(21) Appl. No.: 12/708,906

(22) Filed: Feb. 19, 2010

(65) Prior Publication Data

US 2010/0209838 A1 Aug. 19, 2010

(30) Foreign Application Priority Data

Feb. 19, 2009 (JP) ..... 2009-036073

(51) Int. Cl.
*G03G 9/00* (2006.01)

(52) U.S. Cl. ..... 430/109.4; 430/108.1; 430/109.1

(58) Field of Classification Search ..... 430/108.1, 430/108.7, 109.1, 109.4, 137.1, 137.17
See application file for complete search history.

(56) References Cited

U.S. PATENT DOCUMENTS

| | | | | |
|---|---|---|---|---|
| 5,403,690 | A | | 4/1995 | Kuramoto et al. |
| 5,554,478 | A | | 9/1996 | Kuramoto et al. |
| 5,747,210 | A | * | 5/1998 | Emoto et al. ..... 430/109.4 |
| 5,840,456 | A | | 11/1998 | Tomita et al. |
| 6,074,794 | A | | 6/2000 | Fushimi et al. |
| 6,303,258 | B1 | | 10/2001 | Katoh et al. |
| 6,406,826 | B1 | | 6/2002 | Suzuki et al. |
| 6,500,595 | B1 | | 12/2002 | Mochizuki et al. |
| 6,757,507 | B2 | | 6/2004 | Mochizuki et al. |
| 6,770,411 | B2 | | 8/2004 | Masuda et al. |
| 6,818,369 | B2 | | 11/2004 | Sugiura et al. |
| 6,828,075 | B2 | | 12/2004 | Suzuki et al. |
| 6,861,191 | B2 | | 3/2005 | Mochizuki et al. |
| 6,902,857 | B2 | | 6/2005 | Yagi et al. |
| 7,024,140 | B2 | | 4/2006 | Masuda et al. |
| 7,083,890 | B2 | | 8/2006 | Emoto et al. |
| 7,129,013 | B2 | | 10/2006 | Higuchi et al. |
| 7,169,522 | B2 | | 1/2007 | Sugiura et al. |
| 7,344,812 | B2 | | 3/2008 | Suzuki et al. |
| 7,374,851 | B2 | | 5/2008 | Nakayama et al. |
| 7,429,442 | B2 | | 9/2008 | Honda et al. |

(Continued)

FOREIGN PATENT DOCUMENTS

| | | |
|---|---|---|
| JP | 2547016 | 8/1996 |
| JP | 2000-275907 | 10/2000 |

(Continued)

*Primary Examiner* — Stewart Fraser
(74) *Attorney, Agent, or Firm* — Oblon, Spivak, McClelland, Maier & Neustadt, L.L.P.

(57) ABSTRACT

A toner including a binder resin, a coloring agent, and a releasing agent, the toner formed by dispersing a toner liquid material which is prepared by dispersing the binder resin, the prepolymer, an elongation agent and/or a cross-linking agent for the prepolymer, the coloring agent, and the releasing agent in an organic solvent, dispersing the toner liquid material in an aqueous medium to obtain a liquid dispersion in at least one of cross linking reaction and elongation reaction, and removing the organic solvent from the liquid dispersion, and the toner satisfying the following relationship: 1.35< or = M(g)/M(p)< or =1.90, where M(g) represents the content of the gel composition formed in the at least one of cross linking reaction and elongation reaction and M(P) represents the content of the prepolymer in the toner liquid material when the total of M(P) and the content of the binder resin in the toner liquid material is set to be 100 g.

12 Claims, 1 Drawing Sheet

U.S. PATENT DOCUMENTS

| | | | | |
|---|---|---|---|---|
| 7,437,111 | B2 | 10/2008 | Yamada et al. | |
| 7,473,508 | B2 | 1/2009 | Higuchi et al. | |
| 7,504,188 | B2 | 3/2009 | Yamada et al. | |
| 7,587,161 | B2 | 9/2009 | Yamada et al. | |
| 2005/0112488 | A1 | 5/2005 | Yamada et al. | |
| 2007/0218380 | A1 | 9/2007 | Uchinokura et al. | |
| 2007/0218381 | A1 | 9/2007 | Uchinokura et al. | |
| 2007/0218383 | A1 | 9/2007 | Seshita et al. | |
| 2007/0218385 | A1 | 9/2007 | Kojima et al. | |
| 2008/0070148 | A1 * | 3/2008 | Awamura et al. | 430/111.4 |
| 2008/0076055 | A1 | 3/2008 | Sawada et al. | |
| 2008/0213682 | A1 | 9/2008 | Saitoh et al. | |
| 2008/0227015 | A1 | 9/2008 | Nagatomo et al. | |
| 2008/0227018 | A1 | 9/2008 | Awamura et al. | |
| 2008/0280218 | A1 | 11/2008 | Sabu et al. | |
| 2008/0280219 | A1 | 11/2008 | Nakayama et al. | |
| 2008/0292361 | A1 | 11/2008 | Seshita et al. | |
| 2008/0311500 | A1 | 12/2008 | Yamada et al. | |
| 2009/0061345 | A1 | 3/2009 | Yamada et al. | |
| 2009/0067876 | A1 | 3/2009 | Seshita et al. | |
| 2009/0142093 | A1 | 6/2009 | Sawada et al. | |
| 2009/0142094 | A1 | 6/2009 | Sawada et al. | |
| 2009/0142680 | A1 | 6/2009 | Shimota et al. | |
| 2009/0142682 | A1 | 6/2009 | Saitoh et al. | |
| 2009/0142690 | A1 | 6/2009 | Awamura et al. | |
| 2009/0155709 | A1 | 6/2009 | Watanabe et al. | |
| 2009/0214975 | A1 | 8/2009 | Awamura et al. | |
| 2009/0226836 | A1 | 9/2009 | Uchinokura et al. | |
| 2009/0269692 | A1 | 10/2009 | Awamura et al. | |
| 2009/0280421 | A1 | 11/2009 | Awamura et al. | |

FOREIGN PATENT DOCUMENTS

| | | |
|---|---|---|
| JP | 2001-305797 | 11/2001 |
| JP | 2002-287400 | 10/2002 |
| JP | 3492748 | 11/2003 |
| JP | 2005-77776 | 3/2005 |
| JP | 2005-156586 | 6/2005 |
| JP | 3687469 | 6/2005 |
| JP | 3762075 | 1/2006 |
| JP | 2008-64807 | 3/2008 |
| JP | 4101165 | 3/2008 |
| JP | 4101542 | 3/2008 |

* cited by examiner

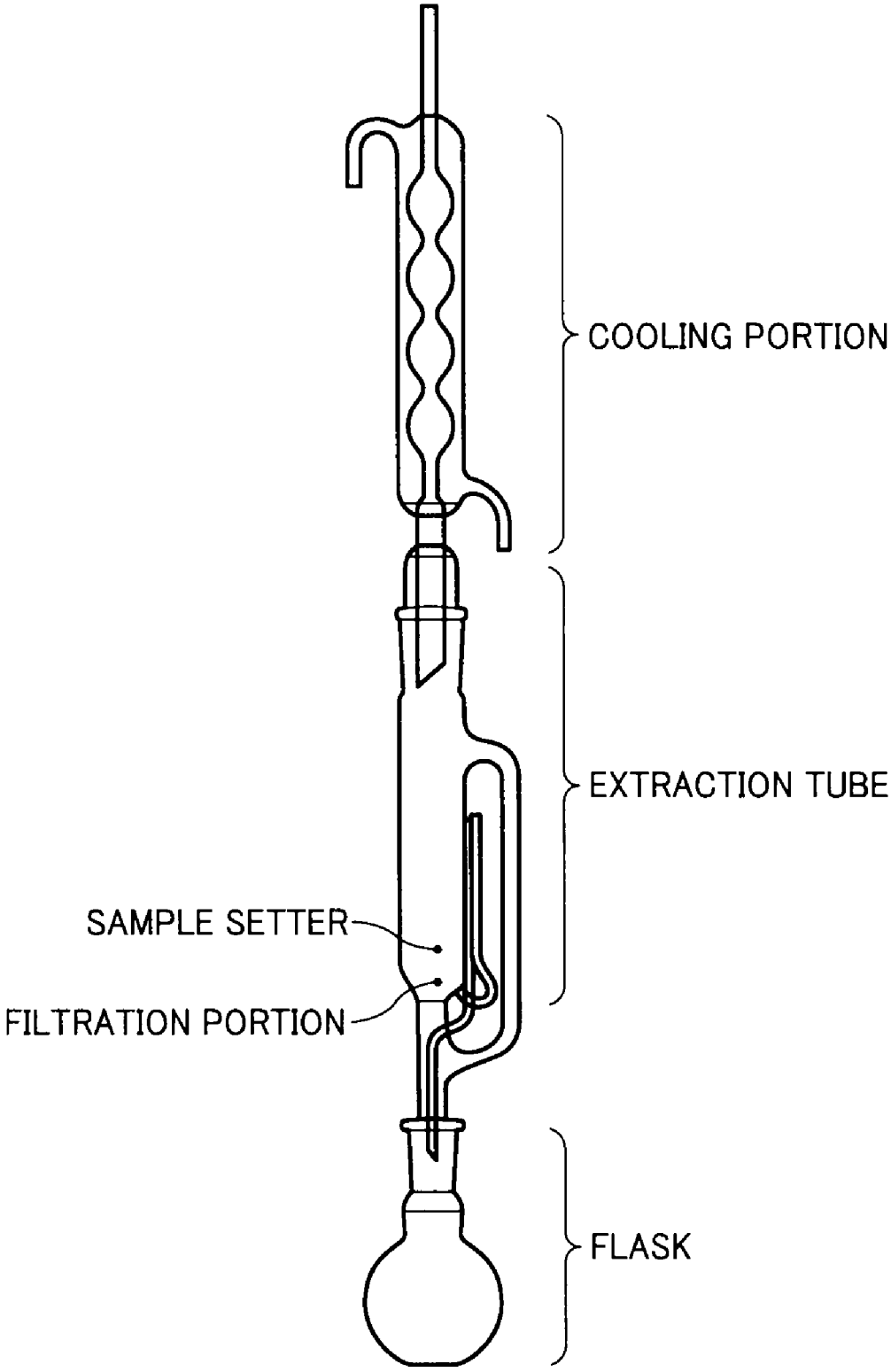
COOLING PORTION
EXTRACTION TUBE
SAMPLE SETTER
FILTRATION PORTION
FLASK

TONER AND DEVELOPMENT AGENT

FIELD OF THE INVENTION

The present invention relates to toner.

DISCUSSION OF THE BACKGROUND

A toner prepared by a typical mixing and kneading method (also referred to as a pulverization method) has been approaching the technical limit with regard to size reduction while involving problems such as an irregular form, a broad particle size distribution, and a high fixing energy. In particular, a releasing agent (wax) tends to exist on the surface of toner particles manufactured by a pulverization method because the toner particles tend to crack at the interface of the releasing agent. Therefore, such toner demonstrates good releasing effect but is not satisfactory about the performance because it easily attaches to carriers, an image bearing member and a blade. Thus, a method of manufacturing a toner by polymerization has been used to overcome such problems related to the toner manufactured by the mixing and kneading method. Toner is easily reduced in size according to this method and the particle size distribution thereof is relatively sharp in comparison with that of the pulverization toner. In addition, such polymerization toner can encapsulate wax. For example, unexamined published Japanese patent applications Nos. (hereinafter referred to as JOP) S63-282752 and H06-250439 describe technologies about the emulsification polymerization agglomeration method and JOPs 2000-275907 and 2001-305797 describe technologies for problems with regard to usage of a surface active agent in the emulsification polymerization agglomeration method. In addition, for example, JOP H11-133665 describes a dry toner having a substantial sphericity of from 0.90 to 1.00 which is formed by elongation reaction of urethane modified polyester functioning as a binder resin to improve the fluidity of toner, a low temperature fixing property, and hot offset resistance. Furthermore, for example, JOPs 2002-287400 and 2002-351143 describe a dry toner having a small particle diameter which has excellent powder fluidity, transferability, high temperature preservability, low temperature fixing property, and hot offset resistance. The methods of manufacturing toner described in these JOPs include a polymerizing process in which addition polymerization reaction is conducted between a polyester prepolymer having an isocyanate group and an amine in an organic solvent and an aqueous medium and a process of removing the organic solvent by heating. Particularly, JOP 2005 describes a method of removing the organic solvent in detail. In addition, for example, JOPs 2001-242663 and 2005-156586 describe a technology to obtain a sharp particle size distribution, and efficiently remove residual polymerizable monomers by controlling the liquid level during manufacturing of polymerization toner. However, in recent years, the market has been demanding reduction of the emission of carbon dioxide to relax the burden on the environment in addition to the further size reduction of the particle diameter to produce quality images, which leads to a strong demand for a further energy-saving machine. However, the low temperature fixing property and the high temperature preservation property are known to have a trade-off relationship.

SUMMARY OF THE INVENTION

Because of these reasons, the present inventors recognize that a need exists for a toner having a good combination of the low temperature fixing property and the high temperature preservability. Accordingly, an object of the present invention is to provide a toner having a good combination of the low temperature fixing property and the high temperature preservability.

Briefly this object and other objects of the present invention as hereinafter described will become more readily apparent and can be attained, either individually or in combination thereof, by a toner including a binder resin, a coloring agent, and a releasing agent, the toner formed by dispersing a toner liquid material which is prepared by dispersing the binder resin, the prepolymer, an elongation agent and/or a cross-linking agent for the prepolymer, the coloring agent, and the releasing agent in an organic solvent, dispersing the toner liquid material in an aqueous medium to obtain a liquid dispersion in at least one of cross linking reaction and elongation reaction, and removing the organic solvent from the liquid dispersion, and the toner satisfying the following relationship: $1.35 < \text{or} = M(g)/M(p) < \text{or} = 1.90$, where M(g) represents the content of the gel composition formed in the at least one of cross linking reaction and elongation reaction and M(P) represents the content of the prepolymer in the toner liquid material when the total of M(P) and the content of the binder resin in the toner liquid material is set to be 100 g.

It is preferable that the toner mentioned above has a glass transition temperature of from 40 to 70° C.

It is still further preferable that, in the toner mentioned above, the binder resin includes a non-modified polyester resin.

It is still further preferable that, in the toner mentioned above, the non-modified polyester resin has a glass transition temperature of from 35 to 65° C.

It is still further preferable that, in the toner mentioned above, the weight average molecular weight of the tetrahydrofuran solution portion in the non-modified polyester resin has at least one peak in a range of from 1,000 to 50,000.

It is still further preferable that, in the toner mentioned above, the content of the non-modified polyester resin in the binder resin is from 50 to 98% by weight.

It is still further preferable that, in the toner mentioned above, the non-modified polyester resin has an acid value of from 1.0 to 50.0 mgKOH/g.

It is still further preferable that, in the toner mentioned above, the maximum dispersion particle diameter of the releasing agent is from 0.05 to 2.0 μm.

It is still further preferable that the toner mentioned above has a volume average particle diameter of from 3 to 7 μm.

It is still further preferable that, in the toner mentioned above, the ratio (Dv/Dn) of the volume average particle diameter (Dv) to the number average particle diameter (Dn) is from 1.00 to 1.15.

As another aspect of the present invention, a development agent is provided which includes the toner mentioned above and an optional carrier.

These and other objects, features and advantages of the present invention will become apparent upon consideration of the following description of the preferred embodiments of the present invention taken in conjunction with the accompanying drawings.

BRIEF DESCRIPTION OF THE DRAWING

Various other objects, features and attendant advantages of the present invention will be more fully appreciated as the same becomes better understood from the detailed description when considered in connection with the accompanying drawing in which like reference characters designate like corresponding parts throughout and wherein:

FIGURE is a diagram illustrating a soxhlet extraction device.

DETAILED DESCRIPTION OF THE INVENTION

The present invention is described in detail with reference to the accompanying drawings and Examples but is not limited thereto.

The toner of the present invention is formed by dispersing a toner liquid material which is prepared by dispersing a binder resin, a prepolymer, at least one of an elongation agent and a cross-linking agent, a coloring agent, and a releasing agent in an organic solvent in an aqueous medium to obtain a liquid dispersion through cross-linking and/or elongation reaction followed by removal of the organic solvent. The toner has a good combination of the low temperature fixing property and the high temperature preservability by satisfying the following relationship about the ratio of M(G) to M(P): 1.35< or =M(g)/M(p)< or =1.90, where M(g) represents the content of the gel composition formed in the elongation and/or cross linking reaction and M(P) represents the content of the prepolymer in the toner liquid material when the total of M(P) and the content of the binder resin in the toner liquid material is 100 g.

The content of the gel composition M(g) in the present invention is obtained by the amount of toner residual from 10 hour soxhlet extraction of the toner using tetrahydrofuran (THF).

The content M(g) of the gel composition in the soxhlet extraction is measured as follows: Weigh about 2 g of a binder resin; place this resin in a cylindrical filter paper having an inner diameter of 24 mm; set the filter paper in an extraction tube; and pour 200 ml of tetrahydrofuran in a flask included in a set to which a condenser is attached; set the flask portion in a mantle heater; reflux the tetrahydrofuran at 80° C.; drop the tetrahydrofuran from the condenser to the resin to extract the tetrahydrofuran soluble portion in the resin into the flask; Subsequent to 10 hour extraction, remove the tetrahydrofuran in the liquid extraction with an reduced pressure to obtain the amount of residual; Obtain the amount of tetrahydrofuran insoluble portion (weight %) from the precise weight (A) of 2 g of the resin and the residual weight (B) of the liquid extraction using the following relationship: Tetrahydrofuran insoluble portion (weight %)=(A−B−W2)/(A−W1−W2)×100, where W1 represents the amount of tetrahydrofuran insoluble component other than the resin in the toner and W2 represents the amount of tetrahydrofuran soluble component other than the resin in the toner. W1 and W2 are separately obtained by a known method such as thermal reduction method according to TG method. The thus obtained tetrahydrofuran insoluble portion (weight %) in the resin contained in the toner is defined as the content M(g) of the gel composition. The amount M(p) of prepolymer for use in the present invention is obtained as follows: The amount M(p) of prepolymer is the weight (g) of the prepolymer in 100 g of the total amount of the resin component contained in the toner liquid material, which are the binder resin and the prepolymer. The toner liquid material (solution or liquid dispersion) is prepared by dispersing or dissolving a binder resin, a prepolymer formed of a modified polyester resin, an elongation agent and/or cross-linking agent of the prepolymer, a coloring agent, a releasing agent, etc. in an organic solvent. That is, M(p) represents the content (weight) of the prepolymer when the total amount of the binder resin and the prepolymer in the toner material. With regard to the toner of the present invention, the ratio of M(G) to M(P) satisfies the following relationship: 1.35< or =M(g)/M(p)< or =1.90. FIGURE is a diagram illustrating the soxhlet extraction instrument used to obtain M(g). In the present invention, the binder resin contains a polyester resin to obtain an excellent low temperature fixing property and in addition preferably a non-modified polyester resin. The molecular weight, monomer compositions, etc., of the polyester resin are suitably selected. The content of the polyester resin in the binder resin is preferably from 50 to 98% by weight. In addition, the binder resin can contain resins other than the polyester resin. Specific examples of such resins include, but are not limited to, a simple monomer or copolymer of such as a styrene based monomer, an acryl based monomer, and methacryl based monomer a polyol resin, a phenol resin, a silicone resin, a polyurethane resin, a polyamide resin, a furan resin, an epoxy resin, a xylene resin, a terpene resin, a coumarone-indene resin, a polycarbonate resin, and an petroleum based resin. These can be used alone or in combination.

The polyester resin for use in the present invention is obtained by dehydration condensation of a polyalocohol and a polycarboxylic acid. Specific examples of the polyalochol include, but are not limited to, diols such as ethylene glycol, propylene glycol, 1,3-butane diol, 1,4-butane diol, 2,3-butane diol, diethylene glycol, triethylene glycol, 1,5-pentane diol, 1,6-hexane diol, neopenthyl glycol, 2-ethyl-1,3-hexane diol, hydrogenated bisphenol, and a compound obtained by adding a cyclic ether such as ethylene oxide, and propylene oxide to bisphenol A. It is preferable to use triols or higher polyols in combination to cross-link the polyester resin. Specific examples thereof include, but are not limited to, sorbitol, 1,2,3,6-hexane tetrol, 1,4-sorbitan, pentaerythritol, dipentaerythritol, tripentaerythritol, 1,2,4-butane triol, 1,2,5-pentane triol, glycerol, 2-methyl propane triol, 2-methyl-1,2,4-butane triol, trimethylol ethane, trimethylol propane, and 1,3,5-trihydroxy methyl benzene. Specific examples of the polycarboxylic acids include, but are not limited to, benzene dicarboxylic acid and anhydrides thereof such as phthalic acid, terephthalic acid, and isophthalic acid, alkyl dicarboxylic acids anhydrides thereof such as succinic acid, adipic acid, sebacic acid, and azelaic acid, unsaturated dibasic acid such as maleic acid, citraconic acid, itaconic acid, alkenyl succinic acid, fumaric acid, and mesaconic acid, anhydrides of unsaturated dibasic acids such as anhydride of maleic acid, anhydride of citraconic acid, anhydride of itaconic acid, and anhydride of alkenyl succinic acid, trimellitic acid, pyromellitic acid, 1,2,4-benzene tricarboxylic acid, 1,2,5-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxy-2-methyl-2-methylene carboxypropane, carboxy)methane, 1,2,7,8-octane tetracarboxylic acid, EnPol trimer acid, anhydrides thereof, partially lower alkyl esters thereof.

In the present invention, the non-modified polyester resin preferably has an acid value of from 1.0 to 50 mgKOH/g, more preferably from 5 to 40 mgKOH/g, and furthermore preferably from 10 to 20 mgKOH/g. An acid value that is too small tends to degrade the affinity between the toner and a recording medium (paper in most cases) and make it difficult to obtain negative chargeability, which may result in deterioration of produced images. In addition, when the acid value is too high, environment such as a high temperature and high humid environment or a low temperature and low humid environment may affect and degrade the quality of produced images.

In addition, the non-modified polyester resin preferably has at least one peak in the range of from 1,000 to 50,000, preferably from 3,000 to 30,000 and further more preferably from 5,000 to 20,000 in the molecular weight distribution of the soluble component in tetrahydrofuran in terms of the fixing property and the hot offset resistance of the toner. Furthermore, the content of the soluble component in tetrahydrofuran of the polyester resin which has a molecular weight of 10,000 or less is preferably from 60 to 100% by weight. The molecular weight of the polyester resin is measured by gel permeation chromatography (GPC) using tetrahydrofuran as a solvent. The prepolymer for use in the present invention preferably contains a polyester resin (hereinafter referred to as polyester prepolymer) having a functional group reactive with an active hydrogen group. A specific examples of the polyester prepolymer is a polyester resin having an isocyanate group. Such a polyester prepolymer is obtained by reacting a polyester resin having an active hydrogen group with isocyanate. Specific examples of the active hydrogen group contained in the polyester resin mentioned above include, but are not limited to, hydroxyl groups (alcohol hydroxyl groups and phenol hydroxyl groups), amino groups, carboxyl groups, and mercarpto groups. Among these, alcohol hydroxyl groups are preferred.

With regard to the resin in the toner formed by cross-linking reaction and/or elongation reaction in the solution or liquid dispersion of polyester resin and polyester prepolymer in an aqueous medium, the unmodified polyester and the modified polyester at least partially are compatibilized in terms of the low temperature fixing property and hot offset resistance. Therefore, the compositions of the polyester resin and the polyester prepolymer are preferably similar to each other. Specific examples of the polyisocyanates include, but are not limited to, aliphatic polyisocyanates (e.g., tetramethylene diisocyanate, hexamethylene diisocyanate and 2,6-diisocyanate methylcaproate); alicyclic polyisocyanates (e.g., isophorone diisocyanate and cyclohexylmethane diisocyanate); aromatic diisosycantes (e.g., tolylene diisocyanate and diphenylmethane diisocyanate); and aromatic aliphatic diisocyanates (e.g., α,α,α',α'-tetramethyl xylylene diisocyanate); isocyanurates; These compounds can be used alone or in combination. In addition, blocked polyisocyanates in which the polyisocyanates mentioned above are blocked with phenol derivatives thereof, oximes or caprolactams, etc. can be also used.

The equivalent ratio of the isocyanate group to the hydroxyl group in the reaction between the polyester resin having a hydroxyl group to the polyisocyanate is from 1 to 5, preferably from 1.2 to 4 and more preferably from 1.5 to 2.5. When this equivalent ratio is too large, the low temperature fixing property tends to deteriorate. When the equivalent ratio is too small, the urea content in the modified polyester obtained in the cross-linking reaction and/or elongation reaction, which is described later, tends to decrease and the hot offset resistance may deteriorate.

The content of the composition deriving from isocyanate in the polyester prepolymer is from 0.5 to 40% by weight, preferably from 1 to 30% by weight, and more preferably from 2 to 20% by weight. A content that is too low may degrade the hot offset resistance of the toner and be disadvantageous in terms of a combination of the high temperature preservability and low temperature fixing property. In contrast, when the content is too high, the low temperature fixing property of the toner easily deteriorates.

In addition, the (average) number of the isocyanate groups per molecule of the polyester prepolymer is 1 or more, preferably from 1.5 to 3 and more preferably from 1.8 to 2.5. When the average number of isocyanate groups is too small, the molecular weight of the modified polyester obtained after cross-linking reaction and/or elongation reaction tends to be small and thus the hot offset resistance easily deteriorates. The weight ratio of the polyester prepolymer to the binder resin is from 5/95 to 50/50, preferably from 10/90 to 30/70 and more preferably from 12/88 to 25/75. A weight ratio that is too low may degrade the hot offset resistance of the toner and be disadvantageous in terms of a combination of the high temperature preservability and low temperature fixing property. In contrast, when the weight ratio is too high, the low temperature fixing property of the toner easily deteriorates.

In the present invention, it is preferable to react the polyester prepolymer and a compound having an active hydrogen group (hereinafter referred to as a cross-linking agent and/or an elongation agent). Hereinafter, this reaction is referred to as cross-linking reaction and/or elongation reaction. Amines can be used as the elongation agent and/or the cross linking agent. The amines include, but are not limited to, diamines, tri- or higher amines, aminoalcohols, aminomercaptans, and amino acids. Specific examples of the diamines include, but are not limited to, aromatic diamines (e.g., phenylene diamine, diethyltoluene diamine, and 4,4-diaminodiphenyl methane); alicyclic diamines (e.g., 4,4-diamino-3,3'-dimethyldicyclohexyl methane, diaminocyclohexane and isophoron diamine); aliphatic diamines (e.g., ethylene diamine, tetramethylene diamine, and hexamethylene diamine); etc.

Specific examples of the polyamines having three or more amino groups include, but are not limited to, diethylene triamine, and triethylene tetramine.

Specific examples of the amino alcohols include, but are not limited to, ethanol amine and hydroxyethyl aniline. Specific examples of the amino mercaptan include, but are not limited to, aminoethyl mercaptan and aminopropyl mercaptan. Specific examples of the amino acids include, but are not limited to, amino propionic acid and amino caproic acid.

Specific examples of the blocked amines include, but are not limited to, ketimine compounds and oxazoline compounds which are prepared by blocking with a ketone such as acetone, methyl ethyl ketone, methyl isobutyl ketone, etc. Among these compounds, diamines and mixtures in which a diamine is mixed with a small amount of a tri- or higher valent polyamine are preferred. The molecular weight of the modified polyester resin can be controlled by optionally using a molecular-weight control agent when conducting the cross-linking reaction and/or elongation reaction. Specific examples of the molecular-weight control agent include, but are not limited to, monoamines (e.g., diethyl amine, dibutyl amine, butyl amine and lauryl amine), and blocked monoamines in which the amino group is blocked (e.g., ketimine compounds and oxazoline compounds which are prepared by blocking with a ketone such as acetone, methyl ethyl ketone, methyl isobutyl ketone, etc.). The equivalent ratio of the isocyanate group of the polyester prepolymer to the amino group of the amine during the cross-linking reaction and/or elongation reaction is preferably from 1/3 to 3/1, more preferably from 1/2 to 2/1, and particularly preferably from 2/3 to 3/2. When the equivalent ratio is too large or too small, the molecular weight of the modified polyester resin tends to decrease and thus degrades the hot offset resistance. The glass transition temperature Tg of the resin in the toner is preferably from 35 to 80° C. and more preferably from 40 to 75° C. When the glass transition temperature Tg is too low, the toner tends to deteriorate in a high temperature environment and offset easily occurs during fixing. In addition, when the glass transition temperature Tg is too high, the fixing property easily deteriorates. In the present invention, the toner preferably has a glass transition temperature of from 40 to 70° C. The glass transition temperature Tg is measured by Rigaku THRMOF- LEX TG 8110, manufactured by Rigaku Corporation under the condition of the temperature rising speed of 10° C./min. An example of the measuring method of Tg is described below. TG-DSC system TAS-100 (manufactured by Rigaku Corporation) is used as the instrument of measuring Tg. Place about 10 mg of a sample in an aluminum sample container, put the container on a holder unit and set the unit in an electric furnace. After heating the sample at a rising temperature speed of 10° C. from room temperature to 150° C. and leave it at 150° C. for 10 minute. Subsequent to cooling down to room temperature, leave it for 10 minutes, and heat the sample again at a rising temperature speed of 10° C. to 150° C. for DSC measurement. Tg is calculated from the crossing point of the tangent around Tg and the base line thereof using the analysis system in TAS-100. In the present invention, a releasing agent is used as a toner component. Hydrocarbon based waxes are used as the releasing agent because these have low melt viscosity and excellent separability with a polyester resin. Releasing agent modified by carboxylic acid, anhydride thereof or preferably an anhydride of maleic acid are preferable to improve the dispersion property of a releasing agent in the toner composition liquid.

Since hydrocarbon waxes generally have weak interaction (mainly hydrocarbon bonding) with polyester resins and organic solvents having a solubility parameter of from 8 to 9.8 [cal m−3]1/2, crystal easily grows in the toner liquid material so that the dispersion diameter of wax is easily great. Therefore, the hydrocarbon waxes are modified by a carboxylic acid or anhydride thereof to introduce a group which has a strong interaction with an organic solvent having a solubility parameter of from 8 to 9.8 [cal m−3]1/2. Therefore, the crustal growth of the hydrocarbon wax in the toner composition liquid can be limited. As a result, the hydrocarbon wax modified by carboxylic acid or anhydride thereof can sustain a fine dispersion state in the toner composition liquid. Specific examples of hydrocarbon waxes include, but are not limited to, polyolefin waxes such as paraffin waxes, SAZOL waxes, polyethylene waxes, and polypropylene waxes. These can be used alone or in combination. Among these, paraffin waxes having a low melting point is preferable in terms of low temperature fixing property. There is no specific limit to the method of modifying hydrocarbon waxes. The methods described in, for example, JOPs S54-81306, S58-43967, S60-16442, H03-199267 and 2000-10338 describe such methods can be used. In the present invention, the releasing agent preferably has an acid value of from 1 to 100 mgKOH/g and more preferably from 3 to 20 mgKOH/g in terms of the dispersion property and offset resistance of the releasing agent. When the acid value is too low, the dispersion property of the releasing agent tends to deteriorate, which causes degrades the characteristics such as the fluidity, charging property, and fixing property of the toner. In addition, when the acid value is too high, the releasing agent easily moves to the aqueous medium when the toner liquid composition is emulsified or dispersed in an aqueous medium. Therefore, the content of the releasing agent in the mother toner particles tends to be small and insufficient, which results in degradation of the hot offset resistance. Furthermore, since the releasing agent tends to coordinate on the surface of mother toner particles, the releasing agent easily fixates on the development device, which leads to deterioration of image quality. In addition, the separation property of the releasing agent from the polyester resin tends to deteriorate, thereby degrading the offset resistance. The acid value is measured by using a voltage potential difference automatic titration device (DL-53 Titrator, manufactured by Mettler-Toledo international Inc.) and analysis software (LabX Light Version 1.00.000). The device is calibrated by a liquid mixture of 120 ml of toluene, and 30 ml of ethanol and the measuring temperature is 23° C. with the following conditions:

Stir Speed [%] 25
Time [s] 15
EQP titration
Titrant/Sensor
Titrant/$CH_3ONa$
Concentration [mol/L] 0.1
Sensor DG115
Unit of measurement mV
Predispersing to volume
Volume [mL] 1.0
Wait Time [s] 0
Titration addition Dynamic
dE (set) [mV] 8.0
dV (min) [mL] 0.03
dV (max) [mL] 0.5
Measure mode Equilibrium controlled
dE {mV] 0.5
dt [s] 1.0
t(min) [s] 2.0
t(max) [s] 20.0
Recognition
Threshold 100.0
Steepest jump only No
Range No
Tendency None
Termination
at maximum volume [mL] 10.0
at potential No
at slope No
after number EQPs Yes
n=1
Comb. termination conditions No
Evaluation
Procedure Standard
Potential 1 No
Potential 2 No
Stop for reevaluation No To be specific, the acid value is measured as follows according to the method described in JIS K0070-1992. Add and dissolve 0.5 g of a sample to 120 ml of toluene by stirring at room temperature (23° C.) for about 10 hours; then, titrate using preliminarily set alcohol solution of 0.1 N potassium hydroxide to obtain the titration amount X; and obtain the acid value from the following relationship: Acid value=X×f×56.1/sample weight [mgKOH/g]. In the relationship, f represents a factor of the alcohol solution of 0.1 N potassium hydroxide.

In the present invention, the releasing agent preferably has a melting viscosity of from 1.0 to 20 mPa sec. at 120° C. and more preferably from 1.0 to 10 mPa sec. When the melting viscosity is too low, the fluidity of the toner tends to be inferior. When the melting viscosity is too large, the offset resistance tends to deteriorate. The melting viscosity is measured by a Brookfield type rotation viscometer.

In the present invention, the releasing agent preferably has a melting point of from 55 to 90° C. The melting point represents the temperature of the endothermic peak at which the endothermic amount is a relative maximum in the differential heat curve obtained by differential scanning calorimetry (DSC). When the melting point is too low, the toner tends to block during preservation, thereby degrading the high temperature preservability. In addition, when the melting temperature is too high, the flow temperature fixing property easily deteriorates. In the present invention, the content of the releasing agent in the mother toner particles is preferably from 1 to 20% by weight and more preferably from 3 to 10% by weight. When the content is too small, the effect of using the releasing agent tends to be in sufficient, thereby degrading the offset resistance. When the content is too large, the fluidity of the toner easily deteriorates and the releasing agent may fixate on a development device. The content of the releasing agent is obtained by measuring the endothermic peak by DSC as in the case of the melting point. To be specific, DSC is preliminarily measured for a predetermined amount of the releasing agent to obtain the melting heat amount Qw (J/mg) per unit weight thereof. Next, DSC is measured for a predetermined amount of the mother toner particle in the same way to obtain the melting heat Qt [J/mg] of the releasing agent contained in the mother toner particle per unit weight from the endothermic peak area of the releasing agent. The content w(X) of the releasing agent in the mother toner particle is obtained by the following relationship: $W(X)=Qt/Qw\times100$ (% by weight).

In the present invention, the releasing agent is preferably dispersed in the mother toner particle. The dispersion diameter (particle diameter in the longest direction: maximum dispersion particle diameter) of the releasing agent is from 0.05 to 2.00 μm and preferably from 0.05 to 1.0 μm. When the dispersion diameter is too large, the variation of the content of the releasing agent among mother toner particles tends to large. This may degrade the fluidity and the charging property or cause fixation of the releasing agent in the development device, which makes it difficult to produce quality images. In addition, when the dispersion particle diameter is too small, the ratio of the releasing agent present inside a mother toner particle increases, thereby degrading the releasing property of the releasing agent. There is no specific limit to the method of measuring the dispersion diameter. For example, the following method can be used. A mother toner particle is embedded in an epoxy resin and sliced to 100 nm followed by dying by ruthenium tetroxide. Next, an image of the slice is taken and evaluated by observation with a transmission electron microscope (TEM) with a power of 10,000. The dispersion state of the releasing agent is observed and the dispersion diameter is measured. Suitable coloring agents (coloring material) for use in the toner of the present invention include known dyes and pigments.

Specific examples of the coloring agents include, but are not limited to, carbon black, Nigrosine dyes, black iron oxide, Naphthol Yellow S, Hansa Yellow (10G, 5G and G), Cadmium Yellow, yellow iron oxide, loess, chrome yellow, Titan Yellow, polyazo yellow, Oil Yellow, Hansa Yellow (GR, A, RN and R), Pigment Yellow L, Benzidine Yellow (G and GR), Permanent Yellow (NCG), Vulcan Fast Yellow (5G and R), Tartrazine Lake, Quinoline Yellow Lake, Anthrazane Yellow BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, Permanent Red (F2R, F4R, FRL, FRLL and F4RH), Fast Scarlet VD, Vulcan Fast Rubine B, Brilliant Scarlet G, Lithol Rubine GX, Permanent Red FSR, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials can be used alone or in combination. In the present invention, the content of the coloring agent in the toner component is preferably from 1 to 15% by weight and more preferably from 3 to 10% by weight. When the content is too small, the coloring power of the toner may deteriorate. When the content is too large, dispersion of the pigment or the dye may not be dispersed well, which leads to the deterioration of the coloring power or the electric characteristics. The toner of the present invention is not particularly limited but can be black toner, cyan toner, magenta toner and yellow toner by selecting the kind of the coloring agent. Master batch pigments, which are prepared by combining a coloring agent with a resin, can be used as the coloring agent of the toner composition of the present invention. Specific examples of such resins include, but are not limited to, polyester, styrene or polymer of substitution product thereof, styrene based copolymers, polymethyl methacrylate, polybutyl methacrylate, polyvinyl chloride, polyvinyl acetate, polyethylene, polypropylene, polyesters, epoxy resins, epoxy polyol resins, polyurethane resins, polyamide resins, polyvinyl butyral resins, acrylic resins, rosin, modified rosins, terpene resins, aliphatic or alicyclic hydrocarbon resins, aromatic petroleum resins, chlorinated paraffin, paraffin waxes, etc. These resins can be used alone or in combination. Specific examples of the polymers of styrene or a substitution product thereof include, but are not limited to, polystyrene, poly-p-chlorostyrene and polyvinyltoluene. Specific examples of the styrene based copolymers include, but are not limited to, styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene styrene-acrylonitrile-indene copolymers, styrene-maleic acid copolymers and styrene-maleic acid ester copolymers The master batch mentioned above is prepared by mixing and kneading a resin and a coloring agent upon application of high shear stress thereto. In this case, an organic solvent can be used to boost the interaction of the coloring agent with the resin. In addition, flushing methods are suitable because the resultant wet cake of the coloring agent can be used as it is without drying. In the flushing method, an aqueous paste including a coloring agent is mixed and/or kneaded with a resin solution of an organic solvent to transfer the coloring agent to the resin solution and then the aqueous liquid and organic solvent are removed. In this case, a high shear dispersion device such as a three-roll mill can be used for mixing and/or kneading the mixture. In the present invention, a charge controlling agent can be used. Specific examples of the charge control agent include, but are not limited to, Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing surface activators, metal salts of salicylic acid, metal salts of salicylic acid derivatives, etc. These can be used alone or in combination. Specific examples of the marketed products of the charge control agents include, but are not limited to, BONTRON 03 (Nigrosine dyes), BONTRON P-51 (quaternary ammonium salt), BONTRON S-34 (metal-containing azo dye), E-82 (metal complex of oxynaphthoic acid), E-84 (metal complex of salicylic acid), and E-89 (phenolic condensation product), which are manufactured by Orient Chemical Industries Co., Ltd.; TP-302 and TP-415 (molybdenum complex of quaternary ammonium salt), which are manufactured by Hodogaya Chemical Co., Ltd.; COPY CHARGE PSY VP2038 (quaternary ammonium salt), COPY BLUE (triphenyl methane derivative), COPY CHARGE NEG VP2036 and NX VP434 (quaternary ammonium salt), which are manufactured by Hoechst AG; LRA-901, and LR-147 (boron complex), which are manufactured by Japan Carlit Co., Ltd.; copper phthalocyanine, perylene, quinacridone, azo pigments and polymers having a functional group such as a sulfonate group, a carboxyl group, a quaternary ammonium group, etc.

The content of the charge control agent is preferably from 0.1 to 10% by weight and more preferably from 0.2 to 5% by weight.

When the content is too low, desired charge control property is not easily obtained. When the content is too high, the toner tends to have an excessively large amount of charge, which reduces the effect of the charge control agent. Therefore, the electrostatic attraction force between a developing roller and the toner increases, resulting in deterioration of the fluidity of the toner and a decrease in the image density.

The toner of the present invention optionally contain inorganic particulates, cleaning property improver, magnetic material, etc. Inorganic particulates are used as external additives to impart fluidity, development property, charging property, etc, to toner. Specific examples of such inorganic particulates include, but are not limited to, silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, silicon nitride, etc. These can be used alone or in combination. The inorganic particulate preferably has a primary particle diameter of from 5 nm to 2 μm, and more preferably from 5 nm to 500 nm. The content of the inorganic particulates in the toner is preferably from 0.01 to 5.0% by weight and more preferably from 0.01 to 2.0% by weight. In addition, the inorganic particulates are preferably surface treated by a fluidizer. Such a fluidizer improves the hydrophobic property of the inorganic particulate to prevent deterioration of the fluidity and charge properties of the toner under high humidity conditions. Specific examples of the fluidizers include, but are not limited to, silane coupling agents, silylation agents, silane coupling agents including a fluoroalkyl group, organic titanate coupling agents, aluminum coupling agents, silicone oils, and modified silicone oils. Silica and titanium oxide are preferably surface treated by a fluidizer because hydrophobic silica and hydrophobic titanium oxide are preferable. The cleaning property improver is used to easily remove toner remaining on an image bearing member or a primary transfer medium after transfer. Specific examples of the cleaning property improvers include, but are not limited to, metal salts of aliphatic acid such as zinc stearate, and calcium stearate and polymer particulates such as polymethyl methacrylate particulates and polystyrene particulates, which are prepared by a soap-free emulsion polymerization method. The polymer particulates preferably have a narrow particle size distribution and the weight average particle diameter thereof is preferably from 0.01 to 1 μm.

Specific examples of the magnetic material include, but are not limited to, iron powder, magnetite, and ferrite. White magnetic material is preferable in terms of the color tone. In the present invention, the mother toner particle preferably has a volume average particle Dv of from 3 to 6 μm, and the ratio (Dv/Dn) of the volume average particle Dv to a number average particle diameter Dn is preferably from 1.00 to 1.15. Therefore, the resultant toner has excellent high temperature preservability, low temperature fixing property, and hot offset resistance and is suitable to obtain excellent gloss property particularly when the toner is used for a full color photocopier. Furthermore, when the toner is used in a two component development agent, the variation of the toner particle diameter is small over an extended period of time in which the toner is consumed and replenished repeatedly. As a result, good development property is maintained during stirring in a development device over an extended period of time. Generally, for example, as a result of relatively rapid consumption of toner particles having a large particle diameter, the content ratio of toner particles having a small particle diameter increases after a long run length. In addition, when the toner is used as a one component development agent, filming of the toner on a development roller or fusion of the toner on the members such as a blade for regulating the thickness of the toner layer can be reduced in addition to a small variation of the toner particle diameter over an extended period of time in which the toner is consumed and replenished repeatedly. As a result, good development property is maintained and quality images are produced during stirring in a development device over an extended period of time. Generally, toner particles having a small particle diameter are said to be advantageous to obtain quality images but disadvantageous in terms of transferability and cleaning property. When toner containing mother toner particles having an excessively small Dv, for example, less than 3 μm, is used in a two component development agent, the toner is easily fused on the surface of a carrier in stirring in a development device over an extended period of time, which causes deterioration of the charging ability of the carrier. In addition, when the toner is used as a one component development agent, filming of the toner on a development roller or fusion of the toner on the members such as a blade for regulating the thickness of the toner layer tends to occur. To the contrary, when the mother toner particle has an excessively large Dv, for example, greater than 6 μm, and Dv/Dn is excessively large, for examples, greater than 1.25, quality images with a high definition can be difficult to obtain and the variation of the toner particle diameter tends to be large when the toner is consumed and replenished repeatedly. In the present invention, Dv and Dn are obtained by measuring with a particle size measuring instrument (Multisizer III, manufactured by Beckman Coulter Co., Ltd) with an aperture diameter of 100 μm and analysis by an analysis software (Beckman Coulter Multisizer 3 Version 3.51). the following is a specific procedure: Place 0.5 ml of 10 wt % aqueous solution of alkylbenzene sulfonate (NEOGEN SC-A, manufactured by Daiichi Kogyo Co., Ltd.) in a glass beaker (100 ml); Add 0.5 g of mother toner in the beaker and stir by a microspatula; then, add 80 ml of deionized water to the mixture. Conduct dispersion treatment for the obtained liquid dispersion by a ultrasonic wave disperser (W-113MK-II, manufactured by Honda Electronics Co., Ltd.) for 10 minutes; and measure the liquid dispersion with the Multisizer III with the measuring liquid of ISOTON III (manufacture by Beckman Coulter Inc.). The toner liquid dispersion sample is dropped such that the density by the device is 6 to 10%. In this measuring method, it is desired that the density should be from 6 to 10% in terms of the measurement reproducibility of the particle diameter.

There is no specific limit to the toner of the present invention with regard to the physical properties such as the size, and form. However, the toner preferably has the following penetration, lowest fixing temperature, limit temperature below which offset does not occur, etc. The toner of the present invention preferably has a penetration of 15 mm or greater and more preferably from 20 to 30 mm. When the penetration is too short, the high temperature preservability tends to deteriorate. The penetration is measured by the penetration test (JIS K2235-1991). Specific procedure is as follows: Fill a glass vessel having a volume of 50 ml with toner; let the container stand in a constant-temperature bath at 50° C. for 20 hours; Cool the toner down to room temperature; and conduct the penetration test. A large penetration value means an excellent heat resistance preservation property. The lowest fixing temperature is preferably less than 150° C. and the limit temperature below which offset does not occur is not lower than 200° C. The lowest fixing temperature is determined as the temperature of the fixing roller below which the remaining ratio of the image density is less than 70% after the fixed image is rubbed by a pad for the image obtained from a photocopying test using an image forming apparatus. In addition, the limit temperature below which offset does not occur is measured by, for example, adjusting an image forming apparatus to develop solid images of each color of yellow, magenta, cyan, and black, and intermediate colors of red, blue, and green while varying the temperature of the fixing belt. The method of manufacturing the toner of the present invention preferably includes a process of dissolving and/or dispersing a toner material in an organic solvent, and a process of emulsifying and/or dispersing the obtained toner liquid material in an aqueous medium with the following optional processes of (1) to (5).

(1) Preparation of Toner Liquid Material

A toner liquid material is prepared by dissolving and dispersing the binder resin, the prepolymer, the compound that elongates and/or cross-links with the prepolymer, the coloring agent, and the releasing agent in an organic solvent.

There is no specific limit to the selection of the organic solvent but an organic solvent having a boiling point of 150° C. or lower is preferable. Specific examples thereof include, but are not limited to, toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethyl ketone and methylisobuthyl ketone. These can be used alone or in combination. Among these, in terms of solubility for the polyester resin, the organic solvent preferably has a solubility parameter of from 8 to 9.8 [cal m−3]1/2, and more preferably 8.5 to 9.5 [cal m−3]1/2. Furthermore, an ester based solvent and a ketone based solvent are preferable because these have a large mutual action with the modification group of the releasing agent so that the crystal growth of the releasing agent is effectively reduced. Among these, ethyl acetate and methylethylketone are particularly preferable because these are easily removed.

The content of the organic solvent is suitably selected and for example, preferably from 40 to 300 parts by weight, more preferably from 60 to 140 parts by weight and particularly preferable from 80 to 120 parts by weight based on 100 parts by weight of a toner material.

In the present invention, it is preferable to heat and dissolve a binder resin and a releasing agent in an organic solvent and then cool down the heated liquid when preparing a toner liquid material. Thereby, the releasing agent is suitably dispersed.

(2) Preparation of Aqueous Medium

The aqueous medium is prepared by, for example, dispersing resin particulates in an aqueous medium. The addition amount of the resin particulates in the aqueous medium is suitably selected and preferable from 0.5 to 10% by weight. Suitable aqueous media include water, and mixtures of water with a solvent which can be mixed with water. Among these, water is preferable. Specific examples of such solvents include, but are not limited to, alcohols (e.g., methanol, isopropanol and ethylene glycol), dimethylformamide, tetrahydrofuran, cellosolves, lower ketones (e.g., acetone and methyl ethyl ketone), etc.

Suitable resins used as the material for the resin particles include any known resins that can disperse in an aqueous dispersion body. Specific examples thereof include, but are not limited to, thermoplastic resins or thermocuring resins such as vinyl resins, polyurethane resins, epoxy resins, polyester resins, polyamide resins, polyimide resins, silicon resins, phenol resins, melamine resins, urea resins, aniline resins, ionomer resins, and polycarbonate resins. These can be used alone or in combination. Among these resins, vinyl resins, polyurethane resins, epoxy resins, and polyester resins are preferably used because an aqueous liquid dispersion of fine spherical particulates can be easily prepared. Specific examples of the vinyl resins include, but are not limited to, polymers, which are prepared by polymerizing a vinyl monomer or copolymerizing vinyl monomers, such as styrene-(meth)acrylate resins, styrene-butadiene copolymers, (meth) acrylic acid-acrylate copolymers, styrene-acrylonitrile copolymers, styrene-maleic anhydride copolymers and styrene-(meth)acrylic acid copolymers.

Also, such resin particulates can be formed by using a monomer having two or more unsaturated groups. Specific examples of the monomer having two or more unsaturated groups include, but are not limited to, sodium salt of sulfuric acid ester of an adduct of methacrylic acid with ethyleneoxide, sivinylbenzene, and 1,6-hexane diol diacrylate. Such resin particulates can be formed by using a known polymerization method and preferably obtained as an aqueous liquid dispersion of the resin particulates. The aqueous liquid dispersion of the resin particulates is prepared by, for example, the following methods of (a) to (h). (a) A method of preparing an aqueous liquid dispersion of resin particulate directly from the polymerization reaction by a suspension polymerization method, an emulsification polymerization method, a seed polymerization method or a dispersion polymerization method from a vinyl monomer as the start material. (b) A method of preparing an aqueous liquid dispersion of resin particulates by: dispersing a precursor (monomer, oligomer, etc.) or its solvent solution under the presence of a suitable dispersion agent; and curing the resultant by heating and/or adding a curing agent in the case of a polyaddition or polycondensation resin such as a polyester resin, a polyurethane resin and an epoxy resin. (c) A method of dissolving a suitable emulsifier in a precursor (monomer, oligomer, etc.) of a polyaddition resin or a polycondensation resin such as a polyester resin, a polyurethane and an epoxy resin, or solvent solution (preferably liquid, and can be liquidified by heating); and adding water for phase change emulsification to prepare an aqueous liquid dispersion of resin particulates. (d) A method of preparing an aqueous liquid dispersion of resin particulates by: fine-pulverizing resins preliminarily manufactured by a polymerization reaction (addition polymerization, ring scission polymerization, polyaddition, addition condensation, polycondensation, etc.) with a fine grinding mill of a mechanical rotation type or jet type; classifying the resultant; and dispersing the obtained resin particulates in water under the presence of a suitable dispersion agent. (e) A method of preparing an aqueous liquid dispersion of resin particulates by: spraying in the form of a fine liquid mist a resin solution in which resins preliminarily manufactured by a polymerization reaction (addition polymerization, ring scission polymerization, polyaddition, addition condensation, polycondensation, etc.) are dissolved in a solvent; and dispersing the obtained resin particulates in water under the presence of a suitable dispersion agent. (f) A method of preparing an aqueous liquid dispersion of resin particulates by: precipitating resin particulates by adding a solvent to a resin solution in which resins preliminarily manufactured by a polymer reaction (addition polymerization, ring scission polymerization, polyaddition, addition condensation, polycondensation, etc.) are dissolved in another solvent or cooling the resin solution preliminarily prepared by heating and dissolving in a solvent; removing the solvent to obtain the resin particulates; and dispersing the obtained resin particulates in water under the presence of a suitable dispersion agent. (g) A method of preparing an aqueous liquid dispersion of resin particulates by: dispersing in an aqueous medium a resin solution in which resins preliminarily manufactured by a polymer reaction (addition polymerization, ring scission polymerization, polyaddition, addition condensation, polycondensation, etc.) are dissolved in a solvent under the presence of a suitable dispersion agent; and removing the solvent by heating, reducing pressure, etc. (h) A method of preparing an aqueous liquid dispersion of resin particulates by: dissolving a suitable emulsification agent in a resin solution in which resins preliminarily manufactured by a polymer reaction (addition polymerization, ring scission polymerization, polyaddition, addition condensation, polycondensation, etc.) are dissolved in a solvent; and adding water for phase change.

In addition, the aqueous medium optionally and preferably contains a dispersion agent in terms that the oil droplets stabilized to have a desired form with a sharp particle size distribution when emulsifying and/or dispersing a toner liquid material. Specific examples of the dispersion agents include, but are not limited to, surface active agents, inorganic compound dispersion agents hardly soluble in water, and polymer protective colloid. These can be used alone or in combination. Among these, anionic surface active agents, cationic surface active agents nonionic surface active agents, and ampholytic surface active agents are preferable. Specific examples of the anionic dispersion agents include, but are not limited to, alkylbenzene sulfonic acid salts, α-olefin sulfonic acid salts, and phosphoric acid salts. Among these, the anionic dispersion agents having a fluoroalkyl group is preferable. Specific examples of the anionic surface active agents having a fluoroalkyl group include, but are not limited to, fluoroalkyl carboxylic acids having 2 to 10 carbon atoms and their metal salts, disodium perfluorooctane sulfonylglutamate, sodium 3-{omega-fluoroalkyl(having 6 to 11 carbon atoms)oxy}-1-alkyl(having 3 to 4 carbon atoms) sulfonate, sodium 3-{omega-fluoroalkanoyl(having 6 to 8 carbon atoms)-N-ethylamino}-1-propanesulfonate, fluoroalkyl(having 11 to 20 carbon atoms) carboxylic acids and their metal salts, perfluoroalkylcarboxylic acids and their metal salts, perfluoroalkyl(having 4 to 12 carbon atoms)sulfonate and their metal salts, perfluorooctanesulfonic acid diethanol amides, N-propyl-N-(2-hydroxyethyl)perfluorooctanesulfone amide, perfluoroalkyl(having 6 to 10 carbon atoms) sulfoneamidepropyltrimethylammonium salts, salts of perfluoroalkyl (having 6 to 10 carbon atoms)-N-ethylsulfonyl glycin, and monoperfluoroalkyl(having 6 to 16 carbon atoms)ethylphosphates. Specific examples of the marketed products of such anionic surfactants having a fluoroalkyl group include, but are not limited to, SURFLON S-111, S-112 and S-113, which are manufactured by Asahi Glass Co., Ltd.; FRORARD FC-93, FC-95, FC-98 and FC-129, which are manufactured by Sumitomo 3M Ltd.; UNIDYNE DS-101 and DS-102, which are manufactured by Daikin Industries, Ltd.; MEGAFACE F-110, F-120, F-113, F-191, F-812 and F-833 which are manufactured by Dainippon Ink and Chemicals, Inc.; ECTOPEF-102, 103, 104, 105, 112, 123A, 306A, 501, 201 and 204, which are manufactured by Tohchem Products Co., Ltd.; and FUTARGENT F-100 and F150 manufactured by Neos Company limited. Specific examples of the cationic surface active agents include, but are not limited to, amine salt type surface active agents and quaternary ammonium salt type anionic surface active agents.

Specific examples of the amine salt type surface active agents include, but are not limited to, alkyl amine salts, amino alcohol fatty acid derivatives, polyamine fatty acid derivatives, and imidazoline.

Specific examples of the quaternary ammonium salt type cationic surface active agents include, but are not limited to, alkyl trimethyl ammonium salts, dialkyl dimethyl ammonium salts, alkyl dimethyl benzyl ammonium salts, pyridinium salts, alkyl isoquinolinium salts, and benzetonium chloride.

Among these, primary, secondary and tertiary aliphatic amines having a fluoroalkyl group, aliphatic quaternary ammonium salts such as perfluoroalkyl (having 6 to 10 carbon atoms) sulfoneamide propyltrimethy lammonium salts, benzalkonium salts, benzetonium chloride, pyridinium salts and imidazolinium salts are preferable.

Specific examples of the marketed products of the cationic surface active agents include, but are not limited to, SURFLON S-121 (manufactured by Asahi Glass Co., Ltd.), FRORARD FC-135 (manufactured by Sumitomo 3M Ltd.), UNIDYNE DS-202 (manufactured by Daikin Industries, Ltd.), MEGAFACE F-150 and F-824 (manufactured by Dainippon Ink and Chemicals, Inc.), ECTOP EF-132 (manufactured by Tohchem Products Co., Ltd.) and FUTARGENT F-300 (manufactured by Neos Company Limited). Specific examples of the nonionic surface active agents include, but are not limited to, fatty acid amide derivatives, and polyalcohol derivatives.

Specific examples of amopholytic surface active agents include, but are not limited to, alanine, dodecyldi(amino ethyl)glycine, bis(octyl amonoethyl)glycine, and N-alkyl-N,N-dimethyl ammonium betaine.

An inorganic compound such as tricalcium phosphate, calcium phosphate, titanium oxide, colloidal silica, and hydroxyapatite can also be used as the inorganic compound dispersant hardly soluble in water. Specific examples of the polymer protective colloids include, but are not limited to, acid monomers, (meth)acrylic monomer having a hydroxyl group, ethers of vinyl alcohol, esters of vinyl alcohol and a compound having a carboxylic group, monomers having amide bonding or methylated compounds thereof, acid chloride monomers, homopolymers or copolymers having a nitrogen atom or a heterocyclic ring having a nitrogen atom, polyoxyethylene based resins and celluloses.

Specific examples of the acid monomers include, but are not limited to, acrylic acid, methacrylic acid, α-cyanoarylic acid, α-cyanomethacrylic acid, itaconic acid, crotonic acid, fumaric acid, maleic acid, and anhydride thereof.

Specific examples of (meth) acrylic monomers having a hydroxyl group β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylates, diethyleneglycolmonomethacrylates, glycerinmonoacrylates, N-methylolacrylamide and N-methylolmethacrylamide.

Specific examples of vinyl alcohol ethers include, but are not limited to, vinyl methyl ether, vinyl ethyl ether and vinyl propyl ether. Specific examples of the esters mentioned above of vinyl alcohol and a compound having a carboxylic group include, but are not limited to, vinyl acetate, vinyl propionate and vinyl butyrate.

Specific examples of the monomers having an amide bonding mentioned above include, but are not limited to, acrylamide, methacrylamide and diacetone acrylamide acid.

Specific examples of the acid chloride monomers include, but are not limited to, chlorides of acrylic acid, and chlorides of methacrylic acid.

Specific examples of the homopolymers or copolymers having a nitrogen atom or a heterocyclic ring having a nitrogen atom include, but are not limited to, vinyl pyridine, vinyl pyrrolidone, vinyl imidazole and ethylene imine.

Specific examples of the polyoxyethylene resins mentioned above include, but are not limited to, polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters.

Specific examples of the celluloses mentioned above include, but are not limited to, methyl cellulose, hydroxyethyl cellulose and hydroxypropyl cellulose.

A dispersion stabilizer can be optionally used in preparation of the aqueous liquid dispersion of resin particulates.

Specific examples of the dispersion stabilizers include, but are not limited to, compounds such as calcium phosphate which are soluble in an alkali or an acid. In addition, when the binder resin contains a polyester prepolymer, the aqueous medium optionally includes catalysts for urea reaction and urethane reaction such as dibutyltin laurate, and dioctyl tin laurate.

(3) Preparation of Emulsified Slurry

Emulsified slurry is prepared by emulsifying and/or dispersing a toner liquid material in an aqueous medium and preferably while being stirred. Specific examples of the devices to emulsify or disperse the toner liquid material include, but are not limited to, batch type emulsification device such as Homogenizer (manufactured by IKA), Polytron (manufactured by Kinematic AG), and TK auto Homomixer (manufactured by Tokushu Kika Kogyo Co., Ltd.), continuous emulsification devices such as Ebara milder (manufactured by Ebara Corporation), TK filmix, TK pipeline Homomixer (both manufactured by Tokushu Kika Kogyo Co., Ltd.), Colloidmil (manufactured by Shinko Pantech Co., Ltd.), slusher, trigonal wet type fine pulverizer (both manufactured by Nippon Coke ans Engineering Co., Ltd.), Cavitron (manufactured by Eurotec Co., Ltd.), and Fineflow mill (manufactured by Pacific Machinery and Engineering Co., Ltd.), high pressure emulsification devices such as Microfluidizer (Available from Mizuho Industrial Co., Ltd.), Nanomizer (manufactured by Nanomizer Inc.), APV Gaulin (manufactured by Gaulin Company), film emulsification devices such as film emulsification machine (manufactured by Reica Co., Ltd.), vibration emulsification devices such as Vibromixer (manufactured by Reica Co., Ltd.), and ultrasonic emulsification devices such as ultrasonic Homogenizer (manufactured by Branson Ultrasonics Division of Emerson Japan Ltd.).

Among these, APV Gaulin, TK auto Homomixer, Ebara milder, TK filmix and TK pipeline Homomixer are preferable n terms of unification of particle diameter.

(4) Removal of Organic Solvent

The organic solvent is removed from emulsified slurry by, for example, a method of evaporating and removing the organic solvent in an emulsified dispersion body by gradually heating the entire reaction system, or a method of spraying an emulsified dispersion body in dried atmosphere to evaporate and remove both of the organic solvent and the aqueous medium.

(5) Washing, Drying, Classification, Etc

Mother toner particles are formed when the organic solvent is removed from the emulsified slurry. The mother toner particles can be washed and dried and optionally classified. For example, the mother toner particles can be classified by removing fine particle components in the aqueous medium by a cyclone, a decanter, a centrifugal, etc. or dried mother toner particles can be classified.

When a compound such as calcium phosphate, which are soluble in an acid and/or alkali, is used as a dispersion stabilizer, the calcium phosphate can be dissolved by adding an acid, for example, hydrochloric acid, followed by washing the resultant particles with water, to remove the calcium phosphate from the particulates.

(6) External Addition of Inorganic Particulates Etc

The mother toner particle can be optionally mixed with inorganic particulates such as silica and titanium oxide and in addition the inorganic particulates can be prevented from detaching from the surface of the mother tone particles by applying a mechanical impact.

Specific examples of such mechanical impact application methods include, but are not limited to, methods in which an impact is applied to the particle by using a blade rotating at a high speed, a method in which the particle is put into a jet air to collide the particle against each other or complicated particles into a collision plate. Specific examples of such mechanical impact applicators (mixer) include, but are not limited to, ONG MILL (manufactured by Hosokawa Micron Co., Ltd.), modified I TYPE MILL (manufactured by Nippon Pneumatic Mfg. Co., Ltd.) in which the pressure of pulverization air is reduced, HYBRIDIZATION SYSTEM (manufactured by Nara Machine Co., Ltd.), KRYPTRON SYSTEM (manufactured by Kawasaki Heavy Industries, Ltd.), automatic mortars, etc.

The toner of the present invention can be used in various kinds of fields and particularly for image formation according to electrophotography.

Development Agent

The toner of the present invention can be used as a toner for a two component development agent including magnetic carriers or a single component development agent.

Any magnetic carriers known as the carrier for use in a two component development agent can be used in combination with the toner of the present invention. Specific examples of such carriers include, but are not limited to, a carrier formed of magnetic particles of iron or ferrite, and a binder type carrier in which magnetic fine powder is dispersed in a binder resin.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

The present invention is described with reference to the accompanying drawings and Examples but is not limited thereto.

Synthesis of Polyester Resin A

The following components are placed in a reaction container equipped with a condenser, stirrer and a nitrogen introducing tube to conduct a reaction at 230° C. for 8 hours:

| | |
|---|---|
| Adduct of bisphenol A with 2 mol of ethylene oxide | 67 parts |
| Adducts of bisphenol A with 3 mol of propion oxide | 84 parts |
| Terephthalic acid | 274 parts |
| Dibutyl tin oxide | 2 parts |

Then, the resultant is caused to conduct 5 hour reaction with a reduced pressure of 10 to 15 mm Hg to synthesize the polyester resin A. The obtained polyester resin A has a weight average molecular weight of 5,600, a glass transition temperature of 55° C. and an acid value of 20 mgKOH/g.

Synthesis of Copolymer of Styrene and Acrylic

The following components are placed in a reaction container equipped with a condenser, stirrer and a nitrogen introducing tube to conduct a reaction at 60° C. for 6 hours:

| | |
|---|---|
| Ethyl acetate | 30 parts |
| Styrene | 200 parts |
| Acrylic monomer | 100 parts |
| Azobisisobutyl nitrile | 5 parts |

Next, 200 parts of methanol is added and stirred for one hour, and then supernatent is removed followed by drying with a reduced pressure to synthesize a styrene acrylic copolymer. The obtained styrene acrylic copolymer has a weight average molecular weight Mw of 16,000 and a glass transition temperature of 57° C.

Preparation of Master Batch

Mix 1,000 parts of water, 540 parts of carbon black (Printe□ 35, manufactured by Degussa Co., Ltd.) having a DBP oil absorption amount of 42 ml/100 mg and a PH of 9.5, and 1,200 parts of the polyester resin A with HENSCHEL mixer (manufactured by Mitsui Mining Co., Ltd.); Mix and knead the mixture with a two-axis roll at 150° C. for 30 minutes; and Subsequent to flatting and cooling down, pulverize the resultant with a pulverizer.

Preparation of Polyester Prepolymer Solution

The following components are placed in a container equipped with a condenser, a stirrer and a nitrogen introducing tube to conduct a reaction at 230° C. at normal pressure for 8 hours followed by another reaction for 5 hours with a reduced pressure of 10 to 15 mmHg to synthesize an intermediate polyester resin:

| | |
|---|---|
| Adduct of bisphenol A with 2 mole of ethylene oxide: | 682 parts |
| Adduct of bisphenol A with 2 mole of propylene oxide: | 81 parts |
| Terephthalic acid: | 283 parts |
| Trimellitic anhydride: | 22 parts |
| Dibutyl tin oxide: | 2 parts |

Then, the resultant is caused to conduct 5 hour reaction with a reduced pressure of 10 to 15 mm Hg to synthesize an intermediate polyester resin. The intermediate polyester resin has an Mn of 2,100, Mw of 9,600, a Tg of 55° C., an acid of 0.5 mgKOH/g, and a hydroxyl value of 49 mgKOH/g. Next, 411 parts of [Intermediate polyester 1], 89 parts of isophorone diisocyanate and 500 parts of ethyl acetate are placed in a reaction container equipped with a condenser, stirrer and a nitrogen introducing tube to conduct reaction at 100° C. for 5 hours to prepare a polyester prepolymer. The obtained polyester prepolymer has a solid portion density of 50% by weight (150° C. left for 45 minutes) and the content of isolated isocyanate of the polyester prepolymer is 1.60% by weight.

Synthesis of Ketimine Compound

In a reaction container equipped with a stirrer and a thermometer, 30 parts of isophoronediamine and 70 parts of methyl ethyl ketone are mixed to conduct reaction at 50° C. for 5 hours to obtain a Ketimine compound. The obtained ketimine compound has an amine value of 423 mgKOH/g.

Synthesis of Modified Paraffin Wax A 100 parts of paraffin wax (HNP-11, manufactured by Nippon Seiro Co., Ltd.) are placed in a reaction container equipped with a stirrer and a thermometer, and heated to 150° C. to melt the wax. Then, a solution in which maleic anhydride and di-t-butylperoxide (organic peroxide) are dissolved in toluene is dropped to conduct reaction for 5 hours while stirring. After the reaction is complete, tolene is removed under nitrogen purge to synthesize modified paraffin wax A. The modified paraffin wax A has a melting point of 69° C., an acid value of 10 mgKOH/g, and a melt viscosity of 10 mPaS at 120° C.

Preparation of Aqueous Medium

Uniformly dissolve the following recipe by mixing and stirring the following recipe to prepare an aqueous medium:

| | |
|---|---|
| Deionized water | 306 parts |
| 10% by weight suspension of tricalcium phosphate | 265 parts |
| Sodium sulfonate of dodecylbenzene | 0.2 parts |

Example 1

10 parts of the polyester preopolymer solution, 75 parts of the polyester resin A and 130 parts of ethyl acetate are placed and dissolved in a beaker by stirring. Next, 5 parts of the modified paraffin wax A and 10 parts of master batch are added followed by treatment using a bead mill (ULTRAVISCOMILL from AIMEX) under the following conditions:

Liquid feeding speed: 1 kg/hour
Disc rotation perimeter speed: 6 m/sec
Diameter of zirconia beads: 0.5 mm
Filling factor of zirconia beads: 80% by volume
Repeat number of dispersion treatment: 3 times Then, 2.7 parts of ketimine compound is added and dissolved therein to prepare a toner liquid material. Emulsification and Dispersion The organic solvent phase, the prepolymer and the ketimine compounds are placed in the reaction container and mixed by a TK type Homomixer (manufactured by Tokushu Kika Kogyo Co., Ltd.) at 5,000 rpm for one minute to obtain an oil phase liquid mixture. Next, 150 parts of the aqueous medium is placed in the reaction container and mixed by a TK type Homomixer (manufactured by Tokushu Kika Kogyo Co., Ltd.) at 3,000 rpm for one minute. Next, 100 parts of the oil phase liquid mixture is added to the reaction container and mixed by a TK type Homomixer (manufactured by Tokushu Kika Kogyo Co., Ltd.) at 13,000 rpm for 20 minutes to prepare a emulsified slurry.

Removal of Solvent, Washing and Drying

Then, 100 parts of the emulsified slurry is placed in a reaction container equipped with a stirrer and a thermometer, and stirred at a stirring peripheral speed of 20 m/minute at 30° C. for 8 hours to remove the solvent followed by four hour aging at 45° C. to prepare a dispersion slurry.

After 100 parts of the dispersion slurry is filtered with a reduced pressure, 100 parts of deionized water is added to the filtered cake and mixed by a TK HOMOMIXER at a rotation number of 12,000 rpm for 10 minutes followed by filtration; After 300 parts of deionized water is added to the filtered cake and the resultant is mixed by a TK HOMOMIXER at a rotation number of 12,000 rpm for 10 minutes, filtration is performed twice. 20 parts of sodium hydroxide aqueous solution is added to the filtered cake and the resultant is mixed by a TK HOMOMIXER at a rotation number of 12,000 rpm for 30 minutes followed by filtration with a reduced pressure. 300 parts of deionized water is added to the filtered cake and the resultant is mixed by a TK HOMOMIXER at a rotation number of 12,000 rpm for 10 minutes followed by filtration. After 300 parts of deionized water is added to the filtered cake and the resultant is mixed by a TK HOMOMIXER at a rotation number of 12,000 rpm for 10 minutes, filtration is performed twice. Furthermore, 20 parts of 10% by weight hydrochloric acid is added to the filtered cake and the resultant is mixed by a TK HOMOMIXER at a rotation number of 12,000 rpm for 10 minutes followed by filtration. After 300 parts of deionized water is added to the filtered cake and the resultant is mixed by a TK HOMOMIXER at a rotation number of 12,000 rpm for 10 minutes, filtration is performed twice to obtain a filtered cake. The obtained cake is dried by a circulation drier at 45° C. for 48 hours. The dried cake is sieved using a screen having an opening of 75 μm to obtain mother particles. The ratio {M (g)/M (p)} of the amount M(g) of gel composition using a value preliminarily obtained by TG method to the amount M(p) of prepolymer is 1.35 based on the value obtained by the soxhlet extraction method using the mother particles.

Example 2

Mother particles of Example 2 are obtained in the same manner as in Example 1 except that the obtained emulsified slurry is dried at 45° C. for 72 hours. The ratio {M(g)/M(p)} of the amount M(g) of gel composition using a value preliminarily obtained by TG method to the amount M(p) of prepolymer is 1.52 based on the value obtained by the soxhlet extraction method using the mother particles.

Example 3

Mother particles of Example 3 are obtained in the same manner as in Example 1 except that the obtained emulsified slurry is dried at 50° C. for 48 hours. The ratio {M(g)/M(p)} of the amount M(g) of gel composition using a value preliminarily obtained by TG method to the amount M(p) of prepolymer is 1.72 based on the value obtained by the soxhlet extraction method using the mother particles.

Example 4

Mother particles of Example 3 are obtained in the same manner as in Example 1 except that the obtained emulsified slurry is dried at 50° C. for 72 hours. The ratio {M(g)/M(p)} of the amount M(g) of gel composition using a value preliminarily obtained by TG method to the amount M(p) of prepolymer is 1.90 based on the value obtained by the soxhlet extraction method using the mother particles.

Comparative Example 1

Mother particles of Comparative Example 3 are obtained in the same manner as in Example 1 except that the obtained emulsified slurry is dried at 43° C. for 48 hours.

The ratio {M (g)/M(p)} of the amount M(g) of gel composition using a value preliminarily obtained by TG method to the amount M(p) of prepolymer is 1.33 based on the value obtained by the soxhlet extraction method using the mother particles.

Comparative Example 2

Mother particles of Example 3 are obtained in the same manner as in Example 1 except that the obtained emulsified slurry is dried at 55° C. for 72 hours. The ratio {M(g)/M(p)} of the amount M(g) of gel composition using a value preliminarily obtained by TG method to the amount M(p) of prepolymer is 2.02 based on the value obtained by the soxhlet extraction method using the mother particles.

Manufacturing of Toner 100 parts of the mother particles, and 1.0 parts of hydrophobic silica (H2000, manufactured by Clariant Japan KK) are mixed with a HENSCHEL MIXER (manufactured by Mitsui Mining Co., Ltd.) at a circumference speed of 30 m/s for 30 seconds followed by a one minute break. This processing is repeated 5 times. Then, the mixture is filtered by a mesh having an opening of 35 μm to prepare a toner.

Manufacturing of Carrier 100 parts of silicone resin organo straight silicone, 5 parts of γ-(2-aminoethyl)aminopropyl trimethoxysilane and 10 parts of carbon black are added to 100 parts of toluene and dispersed with a Homomixer for 20 minutes to prepare a resin layer liquid application. The resin layer liquid application is applied to the surface of 1,000 parts of spherical magnetite having an average particle diameter of 50 μm with a fluid bed coating device to manufacture a carrier. Manufacturing of Development Agent5 parts of toner and 95 parts of carrier are mixed by a ball mill to manufacture a development agent.

Evaluation Method and Evaluation Results

The obtained carrier is evaluated with regard to the following. The evaluation results are shown in Table 1.

Low Temperature Fixing Property

A photocopying test is conducted for a photocopying machine having a remodeled fixing device based on a photocopying machine (MF-200, manufactured by Ricoh Co., Ltd.) roller using a Teflon (Registered) roller as the fixing roller using paper (Type 6200, manufactured by Ricoh Co., Ltd.) while changing the temperature of the fixing roller with a gap of 5° C. The lowest fixing temperature is determined as the temperature of the fixing roller below which the remaining ratio of the image density is less than 70% after the fixing image is rubbed by a pad. A lowest fixing temperature that is low is preferable in terms of the power consumption. A lowest fixing temperature that is 135° C. or lower causes no practical problem and is evaluated as excellent and a lowest fixing temperature that is higher than 135° C. is evaluated as bad.

High Temperature Preservability

Toner is filled in a glass container (50 ml) and left in a constant temperature bath for 24 hours. Subsequent to cooling down to 24° C., the toner is subject to the penetration test (according to JIS K2235-1991) to measure the penetration and evaluate the high temperature preservability. The penetration is evaluated as follows:

25 mm or longer: G (Good)

5 mm to less than 15 mm: F (Fair)

Less than 5 mm: B (Bad)

A large penetration represents good high temperature preservability. A penetration that is less than 5 mm highly probably causes a problem.

TABLE 1

| | Mother toner particle | Glass transition temp. (° C.) of non-polyester resin | Glass transition temp (° C.) of toner | M(g)/M(p) | Low temp. fixing property | High temp. preservability |
|---|---|---|---|---|---|---|
| Example 1 | Toner 1 | 39 | 51 | 1.35 | Good | Good |
| Example 2 | Toner 2 | 49 | 52 | 1.52 | Good | Good |
| Example 3 | Toner 3 | 52 | 58 | 1.72 | Good | Good |
| Example 4 | Toner 4 | 60 | 67 | 1.90 | Good | Good |
| Comp. Example 1 | Toner 5 | 44 | 52 | 1.33 | Good | Bad |
| Comp. Example 2 | Toner 6 | 53 | 62 | 2.02 | Bad | Good |

As seen in Table 1, the ratio of M(g)/M(p) is from 1.35 to 1.90 in Examples 1 to 4. The fixing preservability and the high temperature preservability are confirmed to be excellent.

On the other hand, the ratio of M(g)/M(p) is smaller than 1.35 in Comparative Example 1. Therefore, the toner has no problem with the low temperature fixing property but the high temperature preservability thereof deteriorates.

In addition, the ratio of M(g)/M(p) is greater than 1.90 in Comparative Example 2. Therefore, the toner has no problem with the high temperature preservability but the low temperature fixing property thereof deteriorates.

Therefore, toner of the present invention is found to have a small particle diameter with a sharp particle size distribution while having a good combination of the high temperature preservability and the lower temperature fixing property to produce quality images for an extended period of time. Such toner is provided in the present invention.

This document claims priority and contains subject matter related to Japanese Patent Application No. 2009-036073, filed on Feb. 19, 2009, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A toner comprising, a binder resin;

a coloring agent; and a releasing agent, wherein the toner is formed by dispersing a toner liquid material which is prepared by dispersing the binder resin, a prepolymer, at least one of an elongation agent and a cross-linking agent for the prepolymer, the coloring agent, and the releasing agent in an organic solvent, dispersing the toner liquid material in an aqueous medium to obtain a liquid dispersion in at least one of a cross linking reaction and elongation reaction, and removing the organic solvent from the liquid dispersion, and wherein the toner satisfies the following relationship:

$$1.35 < \text{or} = M(g)/M(p) < \text{or} = 1.90,$$

where M(g) represents a content of a gel composition formed in the at least one of a cross linking reaction and elongation reaction and M(p) represents a content of the prepolymer in the toner liquid material when a total of M(P) and a content of the binder resin in the toner liquid material is set to be 100 g.

2. The toner according to claim 1, wherein the toner has a glass transition temperature of from 40 to 70° C.

3. The toner according to claim 1, wherein the binder resin comprises a non-modified polyester resin.

4. The toner according to claim 3, wherein the non-modified polyester resin has a glass transition temperature of from 35 to 65° C.

5. The toner according to claim 3, wherein a weight average molecular weight of a tetrahydrofuran solution portion in the non-modified polyester resin has at least one peak in a range of from 1,000 to 50,000.

6. The toner according to claim 3, wherein a content of the non-modified polyester resin in the binder resin is from 50 to 98% by weight.

7. The toner according to claim 3, wherein the non-modified polyester resin has an acid value of from 1.0 to 50.0 mgKOH/g.

8. The toner according to claim 1, wherein a maximum dispersion particle diameter of the releasing agent is from 0.05 to 2.0 μm.

9. The toner according to claim 1, wherein the toner has a volume average particle diameter of from 3 to 7 μm.

10. The toner according to claim 1, wherein a ratio (Dv/Dn) of a volume average particle diameter (Dv) to a number average particle diameter (Dn) is from 1.00 to 1.15.

11. A development agent comprising, the toner of claim 1; and a carrier.

12. A method of preparing the toner of claim 1, comprising dispersing a toner liquid material which is prepared by dispersing a binder resin, a prepolymer, at least one of an elongation agent and a cross-linking agent for the prepolymer, a coloring agent, and a releasing agent in an organic solvent, dispersing the toner liquid material in an aqueous medium to obtain a liquid dispersion in at least one of a cross linking reaction and elongation reaction, and removing the organic solvent from the liquid dispersion.

* * * * *